US005983443A

United States Patent [19]

Redding

[11] Patent Number: 5,983,443

[45] Date of Patent: Nov. 16, 1999

[54] ACCESSORY WITH BUILT-IN LIGHT FOR VACUUM CLEANER

[75] Inventor: Glenn E. Redding, Tucson, Ariz.

[73] Assignee: Philips Electronics North America Corporation, New York, N.Y.

[21] Appl. No.: 09/000,669

[22] Filed: Dec. 30, 1997

[51] Int. Cl.[6] ..... A47L 9/30

[52] U.S. Cl. ..... 15/324; 15/377

[58] Field of Search ..... 15/324, 377

[56] References Cited

U.S. PATENT DOCUMENTS

| | | | |
|---|---|---|---|
| 2,637,062 | 5/1953 | Sutton et al. . | |
| 2,734,214 | 2/1956 | Gerber | 15/324 |
| 4,829,625 | 5/1989 | Wang . | |
| 5,560,076 | 10/1996 | Leung | 15/324 X |

FOREIGN PATENT DOCUMENTS

| | | |
|---|---|---|
| 345238 | 9/1976 | Austria . |
| 6827176 | 4/1978 | Austria . |
| 8012221 | 5/1980 | Germany . |
| 9107002 | 9/1991 | Germany . |

*Primary Examiner*—Chris K. Moore
*Attorney, Agent, or Firm*—Ernestine C. Bartlett

[57] ABSTRACT

There is provided an accessory attachment with a built-in light for attachment to a vacuum cleaner. The accessory is preferably of modular design and is detachably connected in air flow relationship to a hose of the vacuum cleaner at one part, is adapted for detachable connection to an attachment such as a crevice tool at one part, and is detachably connected to a power source at one part, preferably a portable power source such as a battery pack, or the power supply line of the vacuum cleaner.

32 Claims, 5 Drawing Sheets

ACCESSORY WITH BUILT-IN LIGHT FOR VACUUM CLEANER

FIELD OF THE INVENTION

This invention relates to an accessory for vacuum cleaners having a built-in light.

BACKGROUND OF THE INVENTION

Vacuum cleaners with a plurality of attachments for performing different functions are well known in the art. For example: a suction nozzle is usually provided with a brush or other agitating means for cleaning carpets or furniture, a crevice tool for cleaning hard to reach areas, a special brush for cleaning upholstery and blinds, as well as other tools for special purposes. U.S. Pat. No. 2,637,062 discloses a vacuum cleaner having an adapter for receiving any such tool that is required, which adapter is provided with lighting means whereby it is unnecessary to provide each tool with a separate lighting means. The adapter in this case includes a handpiece to which one end of flexible hose of the vacuum cleaner is permanently attached. The light is mounted in a socket carried by the permanently attached handpiece and the housing of the adapter is constructed to swivel about the handpiece without interfering with the light. Such a construction having the adapter with light permanently attached to the vacuum cleaner hose often limits use of the various tools, and may be inconvenient to use or provide insufficient illumination to light a specific work area while using the accessory attachment.

SUMMARY OF THE INVENTION

An object of this invention is to provide an easy to use accessory attachment with built-in light for the illumination of a specific work area while using a vacuum cleaner.

Another object of the invention is to provide an accessory attachment with built-in light wherein the accessory is not limited in use due to any necessarily permanent attachment to the vacuum cleaner and wherein the accessory with light is convenient to use and provides sufficient illumination to properly illuminate a specific work area.

These and other objects are realized in accordance with the invention, where there is provided an accessory attachment with built-in light for attachment to a vacuum cleaner, preferably an attachment of modular design, which is detachably connected in air flow relationship to a hose of the vacuum cleaner and which is adapted for detachable connection to an optional power source, preferably an optional portable power source, or to the power supply line of the vacuum cleaner.

In a preferred embodiment of the invention, the accessory attachment with a light comprises a cuff portion having a light circumferentially surrounding a connecting portion adapted to receive an attachment such as a crevice tool or brush. The accessory attachment with built-in light is designed to interfit with an attachment tool.

The light may be one or multiple lights of varying arrangements an or about the cuff and preferably comprises a snap-in lens, a reflector, a bulb, a socket, appropriate connectors and wiring for connection to a power source, and may include an on/off switch on the accessory or it may be activated by a switch on the vacuum cleaner. The light may extend fully around the opening of the accessory and may be in the form of a circular light lens with reflector, or one or more lights of any desired configuration which light or lights also extends around or next to the air path duct of the vacuum cleaner. Alternatively, the light may be asymmetrical, i.e. it may extend around or be next to only a portion of the air duct path.

It is a special feature of the invention that the accessory may be connected to one or more power source options. Thus the accessory may have a power cord for connection on or to a power source on the vacuum cleaner or to a solid extension having internal wiring or to a flexible hose with internal wiring or, in an especially preferred embodiment, to a battery pack whereby the accessory in hand held form may be attached to the desired hose connection.

DETAILED DESCRIPTION OF PREFERRED EMBODIMENTS

Figure 1:
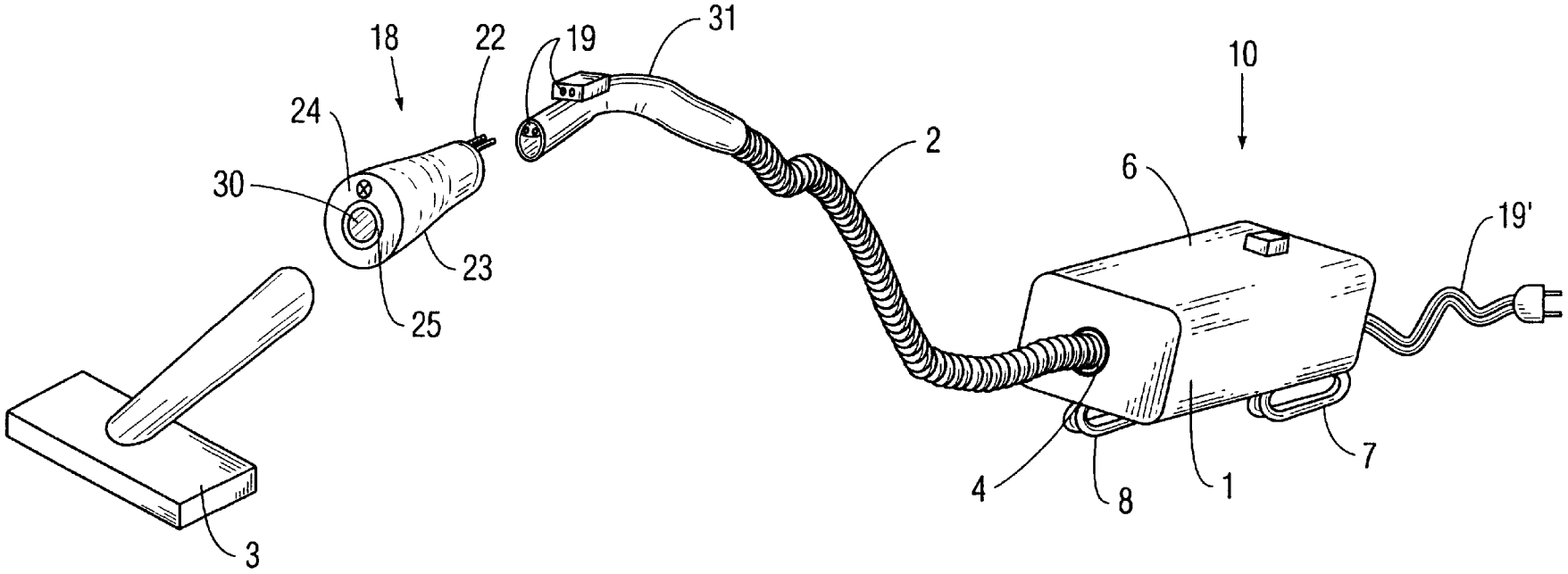
FIG. 1 is a perspective view of a vacuum cleaner with the accessory attachment with built-in light of the invention.

With reference to the drawings, there is disclosed a vacuum cleaner 10 which may be constructed for example, as comprising a vacuum cleaner body 1 with a hose 2 provided with a nozzle 3 coupled to the air inlet 4 of the vacuum cleaner body 1, which body comprises a dust chamber 5 in communication with the air inlet and a housing 6 for a fan driven by an electric motor, which housing is in communication with the dust chamber and the air outlet. Such vacuum cleaners may be of the type commonly referred to as upright or canister.

For ease of description, the invention will be described in terms of a vacuum cleaner. It will be understood that the invention is not to be limited to such terms and any cleaning apparatus with which a lighted accessory may be used is included within the scope of the invention.

Figure 2:
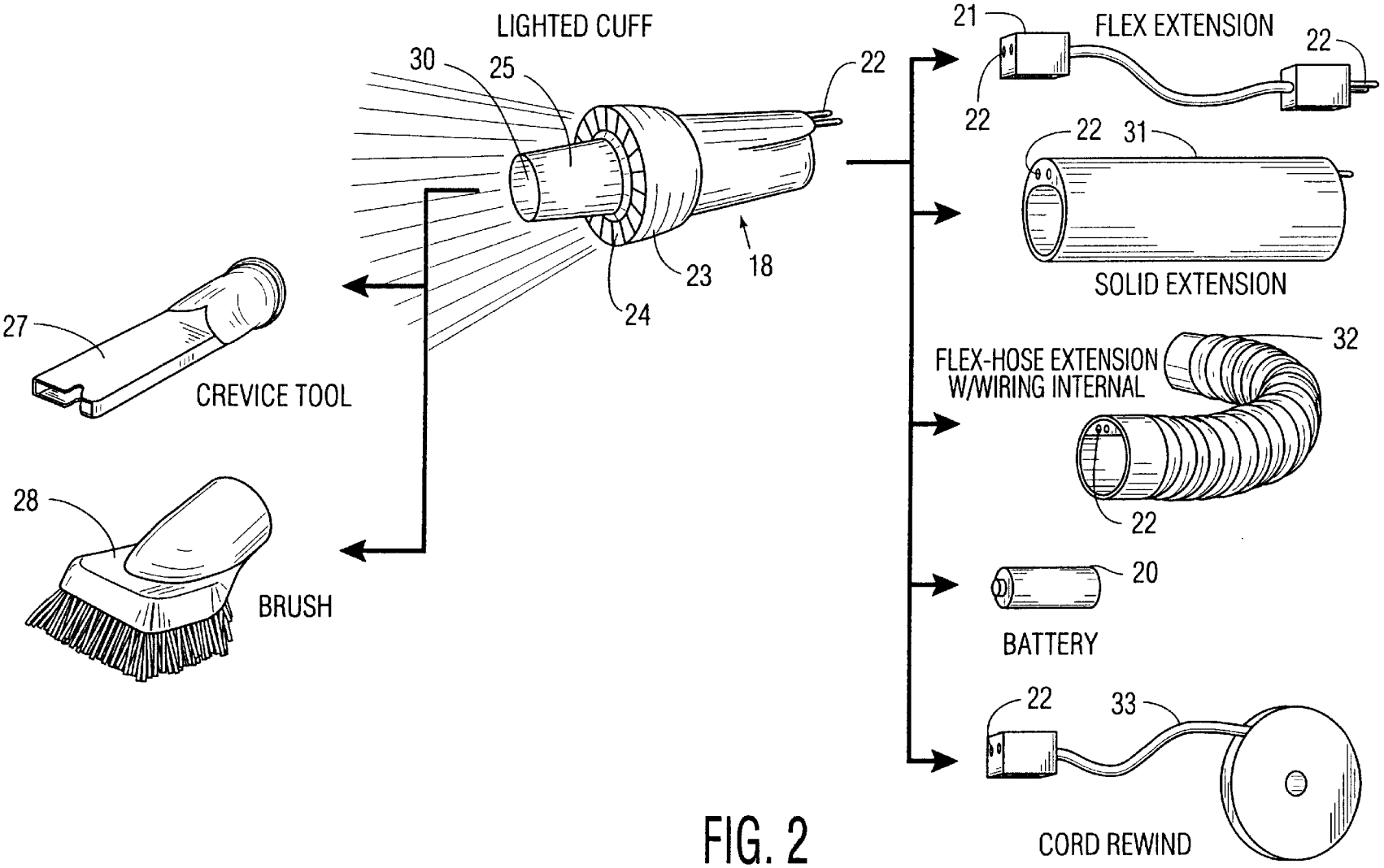
FIG. 2 is an illustration of an accessory attachment with built-in light, alternative attachments, alternative connections to a power source and alternative power source options according to the invention.
Figure 3A:
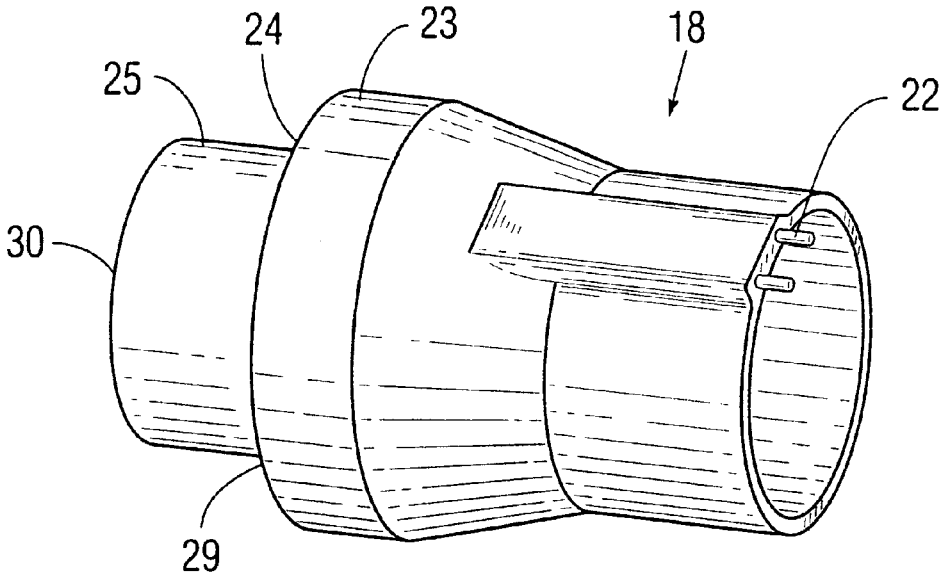
FIGS. 3A and 3B are perspective views of a preferred embodiment of an accessory attachment with built-in light wherein the light is circumferential.
Figure 3B:
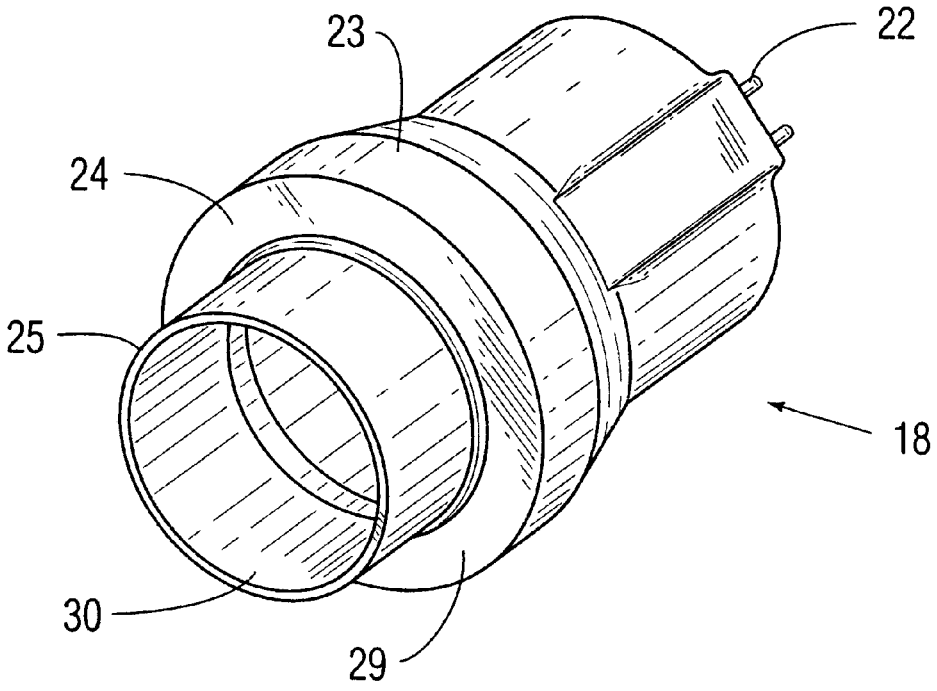
Figure 4:
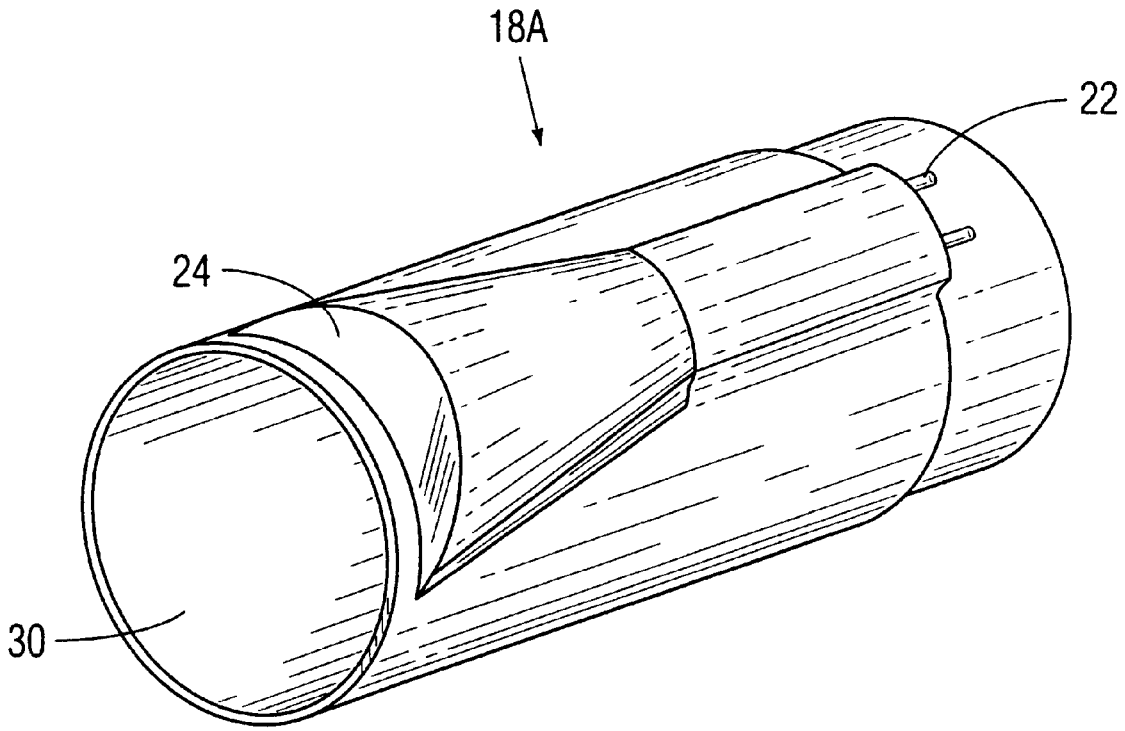
FIG. 4 is a perspective view of an alternative embodiment of an accessory attachment with built-in light wherein the light is asymmetrical.
Figure 5:
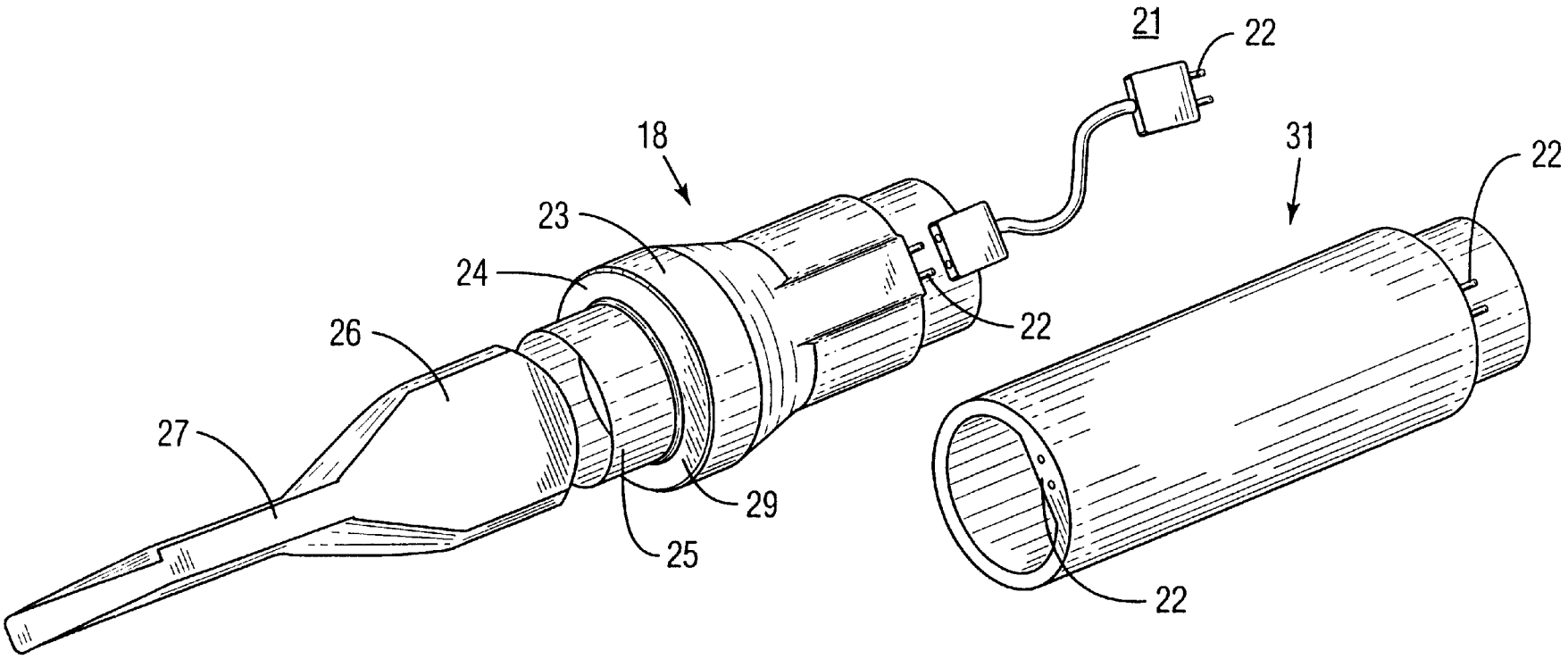
FIG. 5 is a perspective view of an accessory attachment with built-in light having a crevice tool attached, a power cord and a solid extension for connection therewith.

As illustrated in FIGS. 1 to 5, the vacuum cleaner 10 has a housing 6 provided with an electric motor, a body portion 1 which comprises an intake hose 2, a castor wheel 7, and two drive wheels 8. Attached to the hose is accessory attachment with built-in light 18, preferably of modular design, which is detachably connected in air flow relationship to the intake hose 2, which is detachably connected to an attachment tool 26, and which is adapted for detachable connection to a power source 19, which may be in various forms at the option of the user. For example, the power source 19 may be a portable battery pack 20, or it may be connected via plug 21 and connectors 22 to the power supply line 19' of the vacuum cleaner.

In a preferred embodiment of the invention, the accessory attachment with built-in light 18 comprises a cuff portion 23 having a light 24 circumferentially surrounding a connecting portion 25 adapted to receive an attachment 26 such as a crevice tool 27 or a brush 28. The accessory attachment with built-in light 18 is designed to interfit with the attachment 26 as well as with the hose and or various wand parts conventionally used with vacuum cleaners.

The light 24 preferably comprises a snap-in lens 29, a reflector, a bulb, and a socket, (not shown), and appropriate wiring and connectors 22. An on/off switch may be located on the accessory or it may be activated by a switch on the vacuum cleaner. The light 24 may extend fully around the opening/air path duct 30 of the connecting portion 25 of the accessory attachment with built-in light 18 and may be in the form of a circular light lens with reflector that extends around or next to the air path duct 30 of the vacuum cleaner, or it may be asymmetrical as illustrated at 18A in FIG. 4, i.e. it may extend around or be next to only a portion of the air duct path 30.

It is a special feature of the invention that the accessory attachment with built-in light 18 may be connected to one or more power source options. Thus the accessory may have a power cord 21 for connection on or to the vacuum cleaner or to a solid extension 31 having internal wiring 25 or to a flexible hose 32 with internal wiring and connectors 22 or, to a connector on the cord rewind 33, or in an especially preferred embodiment, to a battery pack 20, whereby the accessory attachment with built-in light 18 in hand held form may be attached to the desired attachment 26, 27 or 28.

As various possible embodiments may be made of the above described invention, it is to be understood that all matter herein described or shown in the drawings is to be interpreted as illustrative and not in a limiting sense. Thus it will be appreciated that the drawings are exemplary of a preferred embodiment of the invention.

I claim:

1. An accessory for a vacuum cleaner which accessory comprises a light and is detachably connected at a first part in air flow relationship to a hose of the vacuum cleaner; which is detachably connected in air flow relationship at a second part to an attachment for the vacuum cleaner; and which is adapted for detachable connection at a third part to a power source.

2. An accessory as claimed in claim 1 wherein, said accessory with a light is adapted for detachable connection to a portable power source.

3. An accessory as claimed in claim 1 wherein, the power source is the power supply line of the vacuum cleaner.

4. An accessory as claimed in claim 1 which comprises a cuff portion having a light circumferentially surrounding a connecting portion adapted to receive an attachment tool.

5. An accessory as claimed in claim 4 wherein, the accessory is designed to interfit with the attachment tool.

6. An accessory as claimed in claim 4 wherein, the light comprises a snap-in lens, a reflector, a bulb, and a socket.

7. An accessory as claimed in claim 4 wherein, the light comprises connectors and an on/off switch.

8. An accessory as claimed in claim 4 wherein, the light extends fully around the opening of the accessory.

9. An accessory as claimed in claim 4 wherein, the light is a circular light lens with reflector that extends around the air path duct of the vacuum cleaner.

10. An accessory as claimed in claim 4 wherein, the light is a circular light lens with reflector that extends adjacent the air path duct of the vacuum cleaner.

11. An accessory as claimed in claim 4 wherein, the light is asymmetrical and extends around a portion of the air duct path.

12. An accessory as claimed in claim 4 wherein, the light is asymmetrical and extends adjacent a portion of the air path duct of the vacuum cleaner.

13. An accessory as claimed in claim 4 wherein, the accessory has a power cord for connection on or to the vacuum cleaner as a power source.

14. An accessory as claimed in claim 4 wherein, the accessory is connected to an extension having internal wiring as a power source.

15. An accessory as claimed in claim 4 wherein, the accessory is connected to a flexible hose with internal wiring as a power source.

16. An accessory as claimed in claim 4 wherein, the accessory is connected to a battery pack as a power source.

17. An accessory as claimed in claim 16 wherein, the accessory comprises a cuff portion having a light circumferentially surrounding a connecting portion adapted to receive the attachment.

18. A cleaning apparatus which comprises:

a housing provided with an electric motor, a body portion which comprises an air inlet and an intake hose coupled to the air inlet; an attachment tool adapted for detachable connection to said cleaning apparatus; and an accessory attachment which comprises at least one light and is detachably connected at a first part in air flow relationship to the intake hose of the cleaning apparatus; which is detachably connected in air flow relationship at a second part to the attachment tool; and which is adapted for detachable connection at a third part to a power source.

19. A cleaning apparatus as claimed in claim 18 wherein, said accessory attachment with at least one light is adapted for detachable connection to a portable power source.

20. A cleaning apparatus as claimed in claim 18 wherein, the power source is the power supply line of the cleaning apparatus.

21. A cleaning apparatus as claimed in claim 18 wherein, the accessory attachment with at least one light comprises a cuff portion having a light circumferentially surrounding a connecting portion adapted to receive an attachment tool.

22. A cleaning apparatus as claimed in claim 21 wherein, the accessory attachment with at least one light is designed to interfit with the attachment tool.

23. A cleaning apparatus as claimed in claim 21 wherein, the light comprises a snap-in lens, a reflector, a bulb, and a socket.

24. A cleaning apparatus as claimed in claim 21 wherein, the light comprises connectors and an on/off switch.

25. A cleaning apparatus as claimed in claim 18 wherein, the light extends fully around the opening of the accessory attachment.

26. A cleaning apparatus as claimed in claim 18 wherein, the light is a circular light lens with reflector that extends around the air path duct of the cleaning apparatus.

27. A cleaning apparatus as claimed in claim 18 wherein, the light is a circular light lens with reflector that extends adjacent the air path duct of the cleaning apparatus.

28. A cleaning apparatus as claimed in claim 18 wherein, the light is asymmetrical and extends adjacent a portion of the air path duct of the cleaning apparatus.

29. A cleaning apparatus as claimed in claim 18 wherein, the cleaning apparatus is a vacuum cleaner and the accessory attachment with at least one light has a power cord for connection on or to the vacuum cleaner as a power source.

30. A cleaning apparatus as claimed in claim 18 wherein, the cleaning apparatus is a vacuum cleaner and the accessory attachment with at least one light is connected to an extension having internal wiring as a power source.

31. A cleaning apparatus as claimed in claim 18 wherein, the cleaning apparatus is a vacuum cleaner and the accessory attachment with at least one light is connected to a flexible hose with internal wiring as a power source.

32. A cleaning apparatus as claimed in claim 18 wherein, the cleaning apparatus is a vacuum cleaner and the accessory attachment with at least one light is connected to a battery pack as a power source.

* * * * *